US005947692A

United States Patent [19]

Sahlin et al.

[11] Patent Number: 5,947,692

[45] Date of Patent: Sep. 7, 1999

[54] PERISTALTIC PUMP CONTROLLER WITH SCALE FACTOR THAT VARIES AS A STEP FUNCTION OF PUMP INLET PRESSURE

[75] Inventors: Mark P Sahlin, Hainesville; Timothy J Patno, Mundelein, both of Ill.

[73] Assignee: Baxter International Inc., Deerfield, Ill.

[21] Appl. No.: 08/960,676

[22] Filed: Oct. 30, 1997

[51] Int. Cl.[6] ..... F04B 49/08

[52] U.S. Cl. ..... 417/44.3

[58] Field of Search ..... 604/66, 253, 27, 604/4; 417/307, 53, 477, 474, 478, 44.2, 44.3; 128/214, 213; 210/87

[56] References Cited

U.S. PATENT DOCUMENTS 4,392,849 7/1983 Petre et al. ..... 604/66

4,468,219 8/1984 George et al. ..... 604/55

4,820,281 4/1989 Lawler ..... 604/253

*Primary Examiner*—Charles G. Freay

*Assistant Examiner*—Robert Z. Evora

*Attorney, Agent, or Firm*—Bradford R.L. Price; Denise M. Serewicz; Daniel D. Ryan

[57] ABSTRACT

A controller for a peristaltic pump receives as an input pressure $P_i$ sensed at the inlet of the pump. The controller derives a nonlinear scale factor $S_{Pi}$ that varies as a step function with $P_i$. The scale factor $S_{Pi}$ equals a first nonvariable value when $P_i$ lays in a first defined zone of inlet pressures, and equals a second nonvariable value, different than the first nonvariable value, when $P_i$ lays in a second defined zone of inlet pressures different than the first defined zone of inlet pressures. The controller generates a pump speed command based, at least in part, upon $S_{Pi}$.

4 Claims, 8 Drawing Sheets

36
X(1)
X(2)
X(3)
X(4)
$S_{Pi}$
Z(1)
Z(2)
Z(3)
Z(4)
<P1
P1
P2
P3
>P3
-P
0
+P

36
PMAR
PMAR
PMAR
Z(1)
Z(2)
Z(3)
Z(4)
X(1)
X(2)
X(3)
X(4)
$S_{Pi}$
<P1
P1
P2
P3
>P3
-P
0
+P

PERISTALTIC PUMP CONTROLLER WITH SCALE FACTOR THAT VARIES AS A STEP FUNCTION OF PUMP INLET PRESSURE

FIELD OF THE INVENTION

The invention relates to peristaltic pumping systems and methods.

BACKGROUND OF THE INVENTION

Peristaltic pumps are in widespread use throughout the medical field. In controlling the speed of a peristaltic pump to achieve a given fluid flow rate, a pump calibration factor is usually applied. The calibration factor quantifies the fluid volume that is displaced by one revolution of the pump.

The calibration factor takes into account the physical characteristics of the pump and associated tubing. Pressure present at the inlet of the pump also affects pump performance. The inlet pressure can range from a negative to a positive number and significantly alter the ratio of fluid volume per pump revolution to a greater extent than other variables affecting pump performance. Maintaining accuracy over a wide range of inlet pressures is a worthy objective, but one that has proven difficult to achieve in a practical manner.

SUMMARY OF THE INVENTION

The invention provides an accurate, yet straightforward way of accurately controlling the speed of a peristaltic pump to achieve a desired flow rate over a wide range of positive and negative inlet pump pressures. The invention provides a scale factor $S_{Pi}$, which varies as a function of inlet pressure to maintain an accurate correlation between fluid volume displaced per pump revolution. The scale factor provided by the invention does not vary with inlet pressure in a continuous, linear way. Instead, the pump calibration coefficient varies as a non-linear, discontinuous function of inlet pump pressure. The invention defines zones of inlet pressure, in which zones the value of the scale factor does not vary, but between which zones the value of scale factor changes as a step function. The step function can be expressed in a look-up table format, in which values of the scale factor over a wide range of positive and negative inlet pressures can be listed, to aid in commanding pump speeds to achieve desired fluid flow rates.

The features and advantages of the invention will become apparent from the following description, the drawings, and the claims.

The invention may be embodied in several forms without departing from its spirit or essential characteristics. The scope of the invention is defined in the appended claims, rather than in the specific description preceding them. All embodiments that fall within the meaning and range of equivalency of the claims are therefore intended to be embraced by the claims.

DESCRIPTION OF THE PREFERRED EMBODIMENTS

Figure 1:
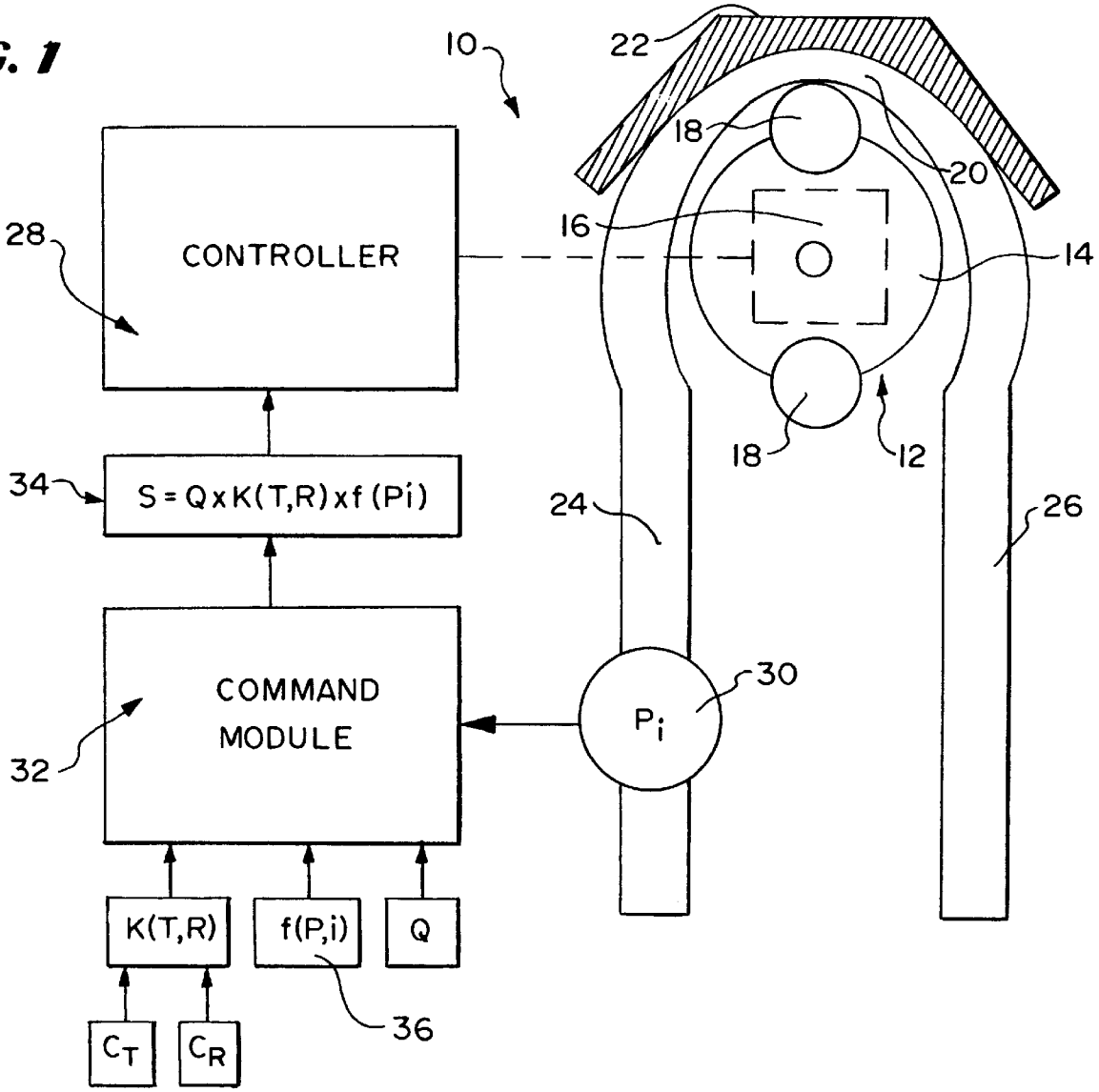
FIG. 1 is a schematic view of a peristaltic pumping system including a command module that generates a pump control command based upon a scale factor, which varies as a step function according to pressure sensed at the pump inlet.

FIG. 1 shows a peristaltic pumping system 10, which embodies the features of the invention.

The system 10 includes a peristaltic pump 12. The pump 12 can be used for processing various fluids. The pump 12 is particularly well suited for processing whole blood and other suspensions of biological cellular materials.

The pump 12 includes a peristaltic pump rotor assembly 14 driven by a motor 16. Various types of motors 16 can be used, e.g., a brushless D.C. motor. The rotor assembly 14 includes a pair of diametrically spaced rollers 18. In use, the rollers 18 engage flexible tubing 20 against an associated pump race 22. An inlet line 24 and an outlet line 26 join the tubing 20. When rotated, the rollers 18 press against and urge fluid through the tubing 20, establishing flow between the inlet and outlet lines 24 and 26 at a desired flow rate Q. This peristaltic pumping action is well known.

A pump motor controller 28 controls power to the pump motor 16. The controller 28 sends command signals to maintain a desired pump speed S (expressed in revolutions per minute) based upon a desired fluid flow rate Q (in ml/min) through the pump tubing 20.

The relationship between the desired fluid flow rate Q and the command pump speed S is expressed as follows:

$$S=Q\times k \tag{1}$$

where:

k (in rev/ml) is a pump calibration coefficient, which expresses the fluid volume that is displaced by one revolution of the pump rotor assembly 14.

As is known, the pump calibration coefficient k is a function, in part, of the dimension and physical characteristics of the pump tubing 20, as well as the dimension and physical characteristics of the pump rotor assembly 14. These dimensional and physical relationships can be readily determined empirically.

It has also been recognized that the fluid volume that is displaced by one revolution of the pump rotor assembly 14 depends upon the pressure existing in the inlet line 24, will be called inlet pressure, or $P_i$. Inlet pressure $P_i$ (in mmHg) can vary significantly during operation and be negative or positive value.

According to the invention, the system 10 shown in FIG. 1 includes a sensor 30 to sense pressure $P_i$ in the inlet line 24. The system 10 also includes a command module 32 coupled to the pump motor controller 28 and the sensor 30. The command module 32 receives, among other inputs to be described later, the inlet pressure $P_i$ sensed by the sensor 30 during operation of the pump rotor assembly 14. The command module 32 generates a pump speed command 34 based, in part, upon the $P_i$ sensed by the sensor 30.

According to the invention, the command module 32 quantifies the value of the pump calibration coefficient k in Equation (1) as follows:

$$k=f(C_T, C_R, S_{Pi}) \tag{2}$$

where:

f is a mathematical function.

$C_T$ is a factor relating to the dimension and physical characteristics of the pump tubing 20.

$C_R$ is a factor relating to the dimension and physical characteristics of the pump rotor assembly 14.

$S_{Pi}$ is a nonlinear scale factor, derived in accordance with a step function 36 (expressed as f ($P_i$) in FIG. 1).

The characteristics $C_T$ and $C_R$ are empirically determined for the pump rotor assembly 14 and the pump tubing 20. Once empirically determined, they together comprise a set value $K_{(T,R)}$, which the command module 32 receives as input (as FIG. 1 shows). The command module 32 treats $K_{(T,R)}$ as an essentially constant value in all zones of positive or negative pressures.

On the other hand, the command module 32 computes the value of the scale factor $S_{Pi}$ according to the step function 36, depending upon where the inlet pressure $P_i$ sensed by the sensor 30 lays with respect to a number (N) of predefined inlet pressure zones Z(N). More particularly, the step function 36 provides a scale factor $S_{Pi}$ that equals a first nonvariable value X(1) when $P_i$ lays in a first defined zone of positive or negative pressures Z(1), and equals a second nonvariable value X(2), different than the first nonvariable value X(1), when $P_i$ lays in a second defined zone of positive or negative pressures Z(2) different than Z(1).

Figure 2:
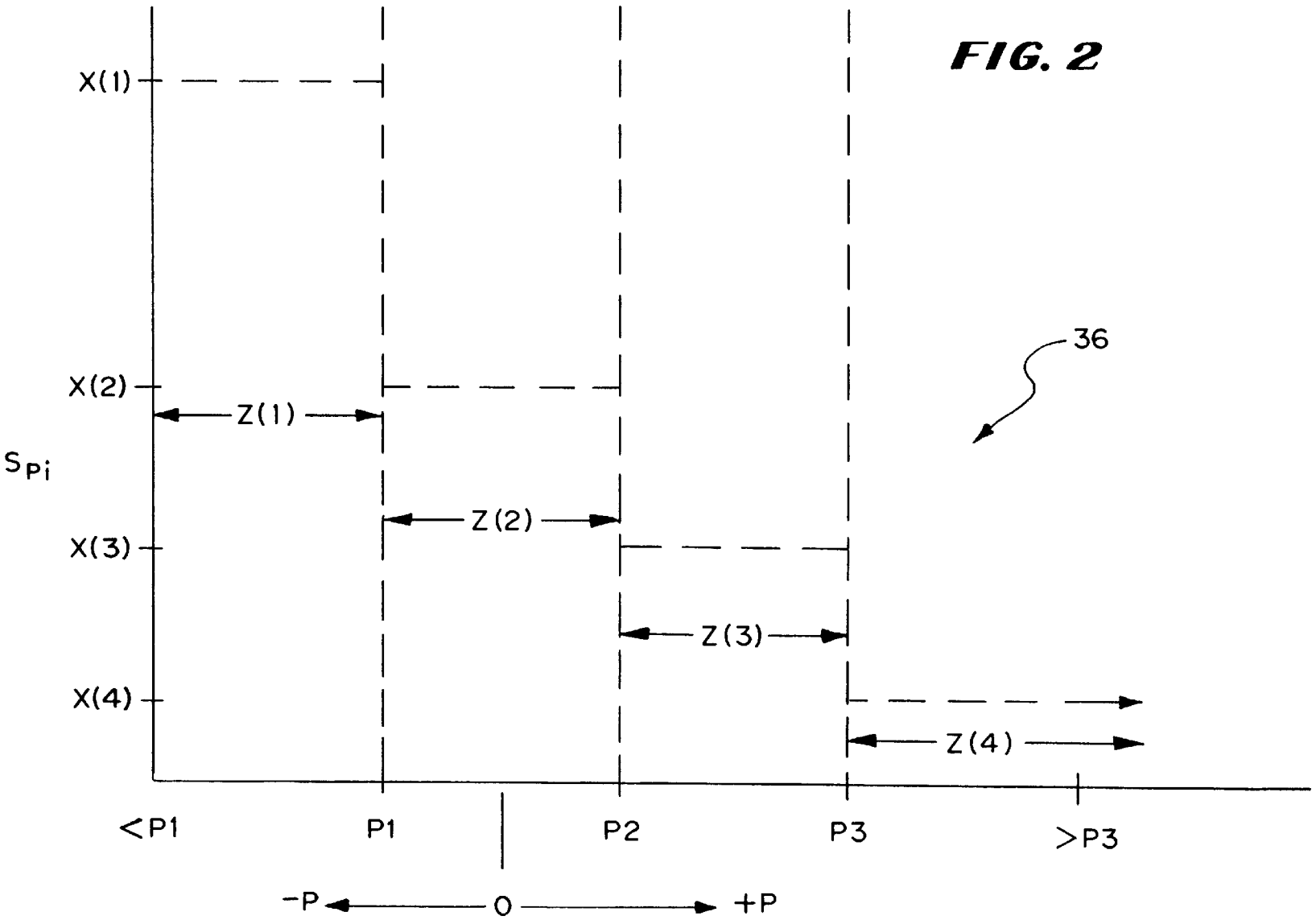
FIG. 2 is a diagrammatic view of the step function by which the scale factor of FIG. 1 is derived, showing the division of the operating range of positive and negative inlet pump pressures into pressure zones, in which zones the value of the scale factor does not vary, but between which zones the value of scale factor changes as a step function.

FIG. 2 graphically shows the step function 36 which determines the scale factor $S_{Pi}$. As FIG. 2 shows, the operating range of inlet pressure $P_i$ comprises at least two positive or negative pressure zones, four of which (designated Z(1) to Z(4)) are shown in FIG. 2, as follows:

$Z(1)=-P1>P_i$; $S_{Pi}=X(1)$.

$Z(2)=-P1<P_i\leqq+P2$; $S_{Pi}=X(2)$.

$Z(3)=+P2<P_i\leqq+P3$; $S_{Pi}=X(3)$.

$Z(4)=+P3<P_i$; $S_{Pi}=X(4)$.

Within each pressure zone Z(1) to Z(4), the scale factor $S_{Pi}$ comprises a different, nonvariable value (designated X(1) to X(4)). Between the zones Z(1) to Z(2), Z(2) to Z(3), and Z(3) to Z(4), the values X(1, 2, 3, 4) change as a non-linear step function.

The boundaries of the pressure zones Z(N) and the associated scale factors X(N) can be empirically defined for a given pump in a manner described in greater detail later.

The command module 32 can store the step function 36 of $S_{Pi}$ depicted in FIG. 2 in look-up table format, which Table 1 exemplifies.

TABLE 1

Look Up Table for $S_{Pi}$

| Sensed Pressure $P_i$ | Scale Factor |
|---|---|
| $P_i \leqq -P1$ | X(1) |
| $-P1 < P_i \leqq +P2$ | X(2) |
| $+P2 < P_i \leqq +P3$ | X(3) |
| $P_i > +P3$ | X(4) |

As FIG. 1 shows, the command module 32 also receives as input the desired flow rate Q. The command module 32 generates as the command output 34 to the pump motor controller 28, the desired pump speed S, which the command module 32 derives as follows:

$$S=Q\times K_{(T,R)}\times S_{Pi(ZN)} \tag{3}$$

To prevent $S_{Pi}$ from stepping too frequently as a result of relatively small fluctuations in $P_i$ near the transitions between zones Z(1,2,3,4), the command module 32 preferably incorporates buffer margins PMAR (mmHg). The buffer margins PMAR are established above and below the transitions between the zones Z(1, 2, 3, 4).

Figure 3:
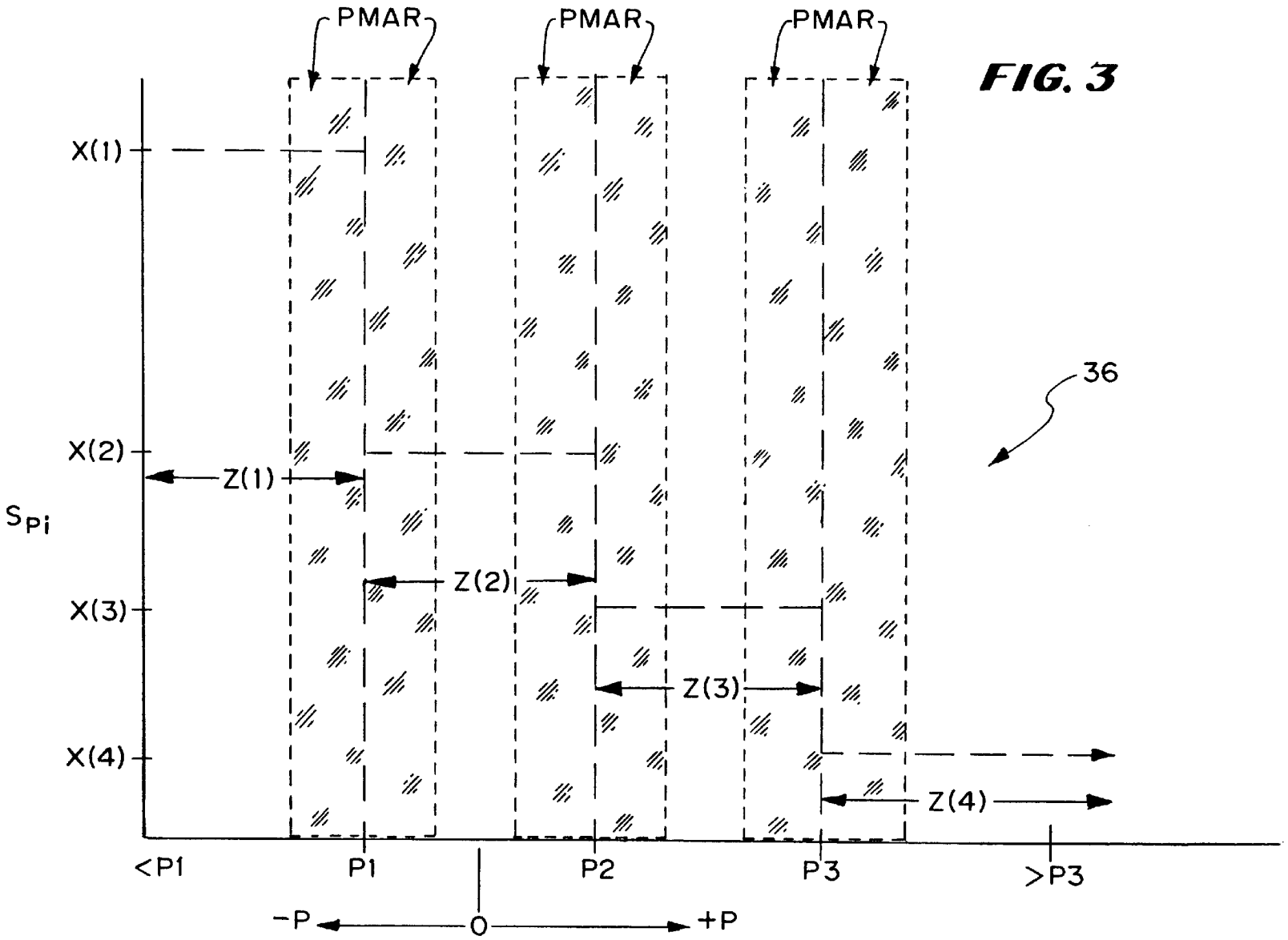
FIG. 3 is a diagrammatic view of the step function shown in FIG. 2, with buffer margins established between the pressure zones.

FIG. 3 diagrammatically illustrates the presence of the buffer margins PMAR. The buffer margins, in effect, broaden the boundaries between the zones Z (1, 2, 3, 4). With the buffer margins PMAR implemented, the command module 32 derives $S_{Pi}$ as follows:

(i) If the current $P_i$ is more than PMAR above the current zone Z(N), the command module 32 steps up $S_{Pi}$ to the value X(N+1) applicable to the next higher zone Z(N+1). However, as long as the current $P_i$ remains less than PMAR above the current zone Z(N), the command module 32 does not change the current value X(N) of $S_{Pi}$.

(ii) If the current $P_i$ is more than PMAR below the current zone Z(N), the command module 32 steps down $S_{Pi}$ to the value x(N−1) applicable to the next lower zone Z(N−1). However, as long as the current $P_i$ remains greater than PMAR below the current zone Z(N), the command module 32 does not change the current value X(N) of $S_{Pi}$.

The following Example illustrates the derivation of $S_{Pi}$ for a given peristaltic pump.

EXAMPLE

A set of scale factors $S_{Pi}$ was derived for a peristaltic pump of the type shown in Chapman U.S. Pat. No. 5,462,417. The pump tubing for the pump was coupled to a cassette, also shown and described in Chapman U.S. Pat. No. 5,462,417, which consolidated pressure sensing and liquid flow valving functions. Further details of the construction of the pump and cassette are not material to this invention, but can be found in Chapman U.S. Pat. No. 5,462,417, which is incorporated herein by reference.

Six pumps of the type shown in Chapman U.S. Pat. No. 5,462,417 were evaluated in association with different cassettes, to determine the effect of variation of inlet pressure upon liquid flow rate, given a constant rate of pump rotor rotation. For each pump-cassette association, rotational rates of 30 RPM, 60 RPM, and 100 RPM were commanded in the same direction (clockwise). For each commanded rotation rate, inlet pressure were established and maintained at values, which were varied between −400 mmHg and 800 mmHg. For each commanded rotational rate and commanded inlet pressure, the liquid flow rate through the pump tubing was measured.

From the data obtained for each pump-cassette association, a family of characteristic curves was plotted, which showed the effect of pressure on flow rate for that pump-cassette association at the commanded pump rotational rates. For each pump-cassette association, flow rate was normalized to pump rotational rate by creating a percentage ratio, in which flow rate constitutes the numerator and rotational rate constituted the denominator.

Figure 4:
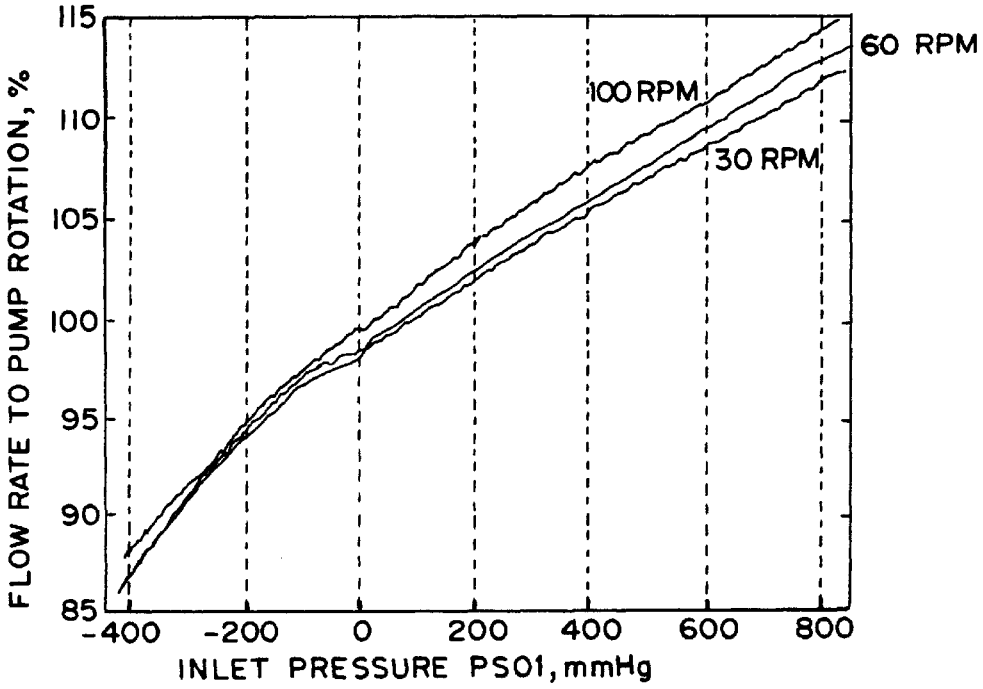
FIG. 4 shows a representative family of characteristic curves for a given operational pump configuration, showing, for each of the commanded rotational rates (30 RPM, 60 RPM, and 100 RPM), the change of the flow rate-to-rotational rate percentage ratio (plotted on the Y-axis) in relation to variations in inlet pressure (plotted along the X-axis)

FIG. 4 shows a representative family of characteristic curves for a given pump-cassette association. FIG. 4 shows, for each of the commanded rotational rates (30 RPM, 60 RPM, and 100 RPM), the change of the flow rate-to-rotational rate percentage ratio (plotted on the Y-axis) in relation to variations in inlet pressure (plotted along the X-axis). FIG. 4 shows that, for the pump-cassette association, the flow rate-to-rotational rate percentage ratio increased with a close to linear characteristic as the inlet pressure increased, and that this characteristic was not significantly affected by rotational rate. This characteristic was common to all the pump-cassette associations evaluated.

Figure 5:
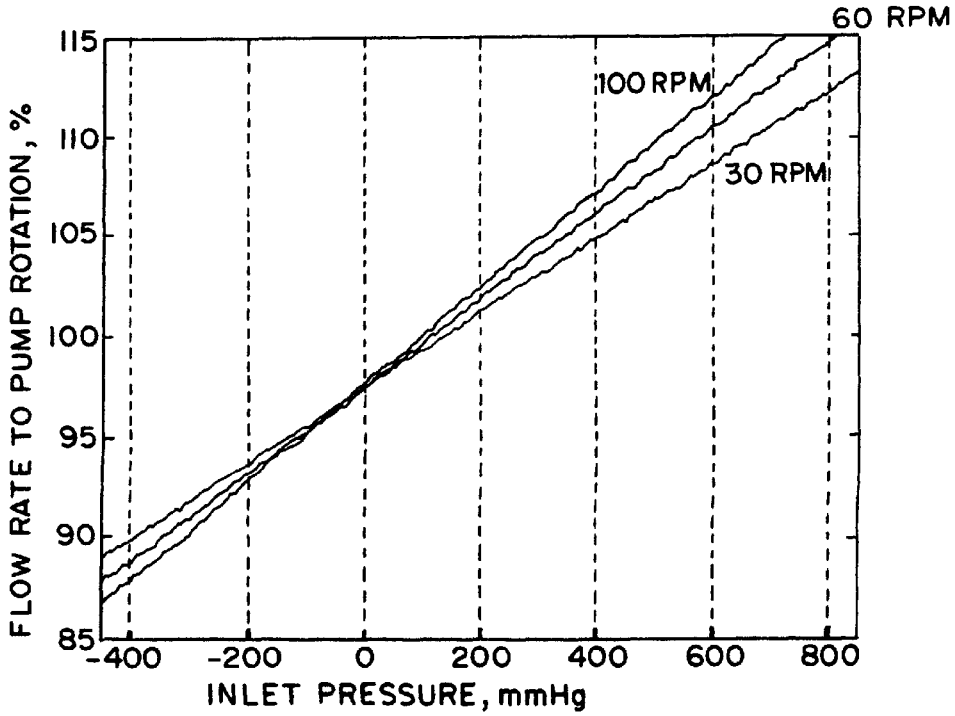
FIG. 5 shows a representative family of curves, which represents the average of the linear fits and range of variation at 30 RPM, 60 RPM, and 100 RPM for six similar configurations of like pumps, driven in both clockwise and counter-clockwise rotational directions, demonstrating substantially similar slopes and y-intercepts as the family of curves in FIG. 4.

Using the same cassette, six different pumps were evaluated in the manner just described, at commanded pump rates of 30 RPM, 60 RPM, and 100 RPM, at both clockwise and counter-clockwise rotational directions. The data for all six pumps-single cassette associations was linearized and averaged. FIG. 5 shows the resulting family of curves, which represents the average of the linear fits and range of variation at 30 RPM, 60 RPM, and 100 RPM for all six pumps-single cassette associations, at both clockwise and counter-clockwise rotational directions.

Figure 6:
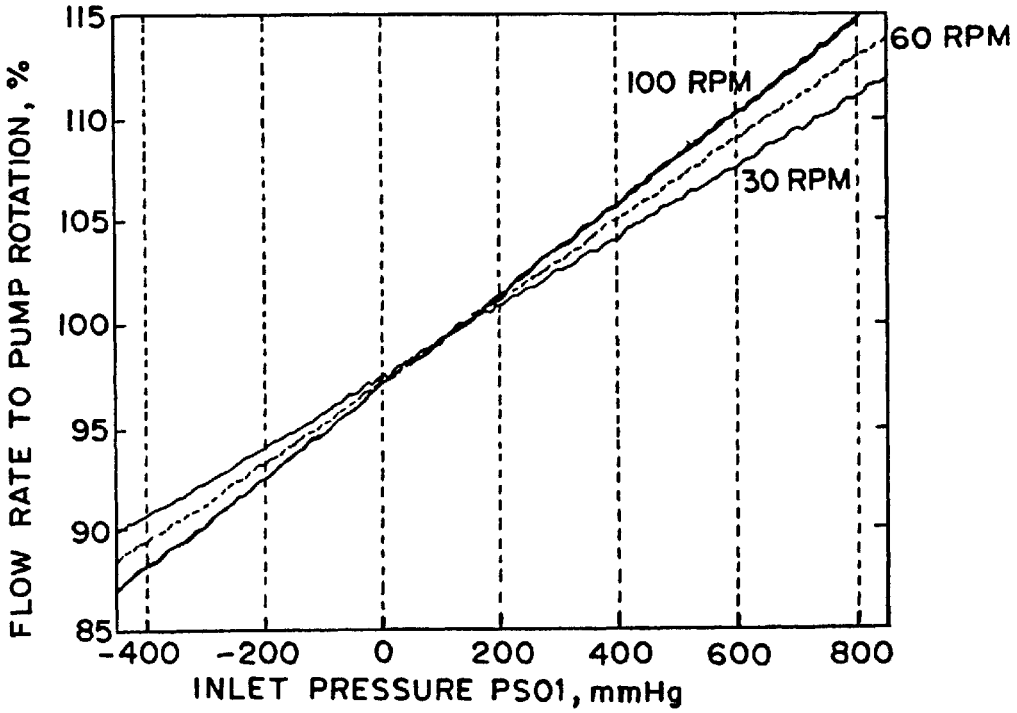
FIG. 6 shows a representative family of curves, which represents the average of the linear fits and range of variation at 30 RPM, 60 RPM, and 100 RPM for six dissimilar configurations of like pumps, driven in both clockwise and counter-clockwise rotational directions, demonstrating substantially similar slopes and y-intercepts as the family of curves in FIGS. 4 and 5.

The same six pumps were also evaluated in association with four different cassettes, in the manner just described, at commanded pump rates of 30 RPM, 60 RPM, and 100 RPM, at both clockwise and counter-clockwise rotational directions. The data for all six pumps-four cassette associations was also linearized and averaged. FIG. 6 shows the resulting family of curves, which represents the average of the linear fits and range of variation at 30 RPM, 60 RPM, and 100 RPM for all six pumps-four cassette associations, at both clockwise and counter-clockwise rotational directions.

FIGS. 4, 5, and 6 demonstrate that the overall offsets and slopes of the multiple families of curves for the multiple pump-cassette associations evaluated do not vary significantly. An average for all families of curves for the multiple pump-cassette associations evaluated can be linearized and expressed with the following slope/y-intercept function:

$$\text{RateRatio}(\%)=97.38+0.207(P_i) \tag{4}$$

where:

$$RateRatio\ (\%) = \frac{Q_{Sensed}}{S_{Command}}$$

and where $Q_{Sensed}$ is the actual liquid flow rate, and $S_{Command}$ is the commanded pump speed.

FIGS. 4, 5, and 6 thereby demonstrate a uniformly significant relationship between pump flow rate and inlet pressure or vacuum at a given rotational rate. The presence of a positive pump inlet pressure results in an actual flow rate that is higher than the commanded flow rate. The presence of a negative pump inlet pressure (vacuum) results in an actual flow rate that is lower than the commanded flow rate. Given a constant pump rotational rate, the actual pump flow rate can vary as much as plus or minus 15%, due to inlet pressure or vacuum.

FIGS. 4, 5, and 6 also demonstrate that, among the variables affecting pump performance, the factor having the most significant effect is the inlet pressure. Effects on the variance of flow rate versus commanded pump rate due to the range of pump rate commands, pump rotational direction, variations in pump tubing and associated flow tubing (e.g., the cassette), and outlet pump pressure are insignificant compared to the effect of inlet pump pressure in commanding a precise flow rate.

Figure 7:
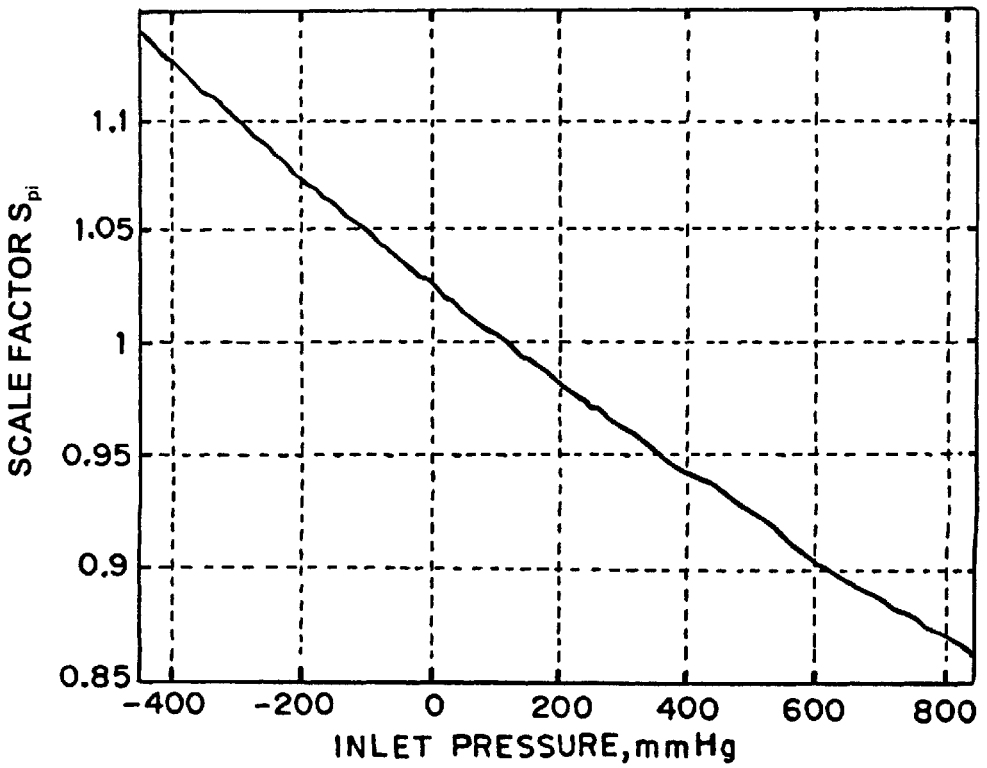
FIG. 7 is a plot of a continuous scale factor, based upon the similar slopes and y-intercepts as the family of curves in FIGS. 4, 5, and 6, by which a pump rotational rate can be continuously adjusted by a linear calibration factor within an operational range of inlet pressures to achieve a desired flow rate.

Given the relationship expressed in Equation (4), the rotational rate can be adjusted by a linear scale for the operational range of inlet pressures to achieve a desired flow rate. FIG. 7 shows the plot of this continuous scale factor, based upon the relationship expressed in Equation (4).

However, it has been discovered that it is not necessary to implement a continuous, linear scale factor over a range of operational inlet pressures. Instead, discrete scale factors can be defined for discrete pressure ranges.

First, given the characteristics and operational objectives of a particular fluid flow system, nominal zones of expected operational pressure conditions are defined. For example, in a typical blood processing system, four nominal zones can be defined. The nominal zones characterize (i) a low vacuum (negative pressure) condition (e.g., under −50 mmHg); (ii) a transitional ambient negative to positive pressure condition (e.g., −50 mmHg to 100 mmHg); (iii) a low range of positive pressure conditions (e.g., 100 mmHg to 230 mmHg); and (iv) a high range of positive pressure conditions (e.g., above 230 mmHg). Of course, fewer or more nominal zones can be defined, depending upon criteria that the operator believes are most relevant to the operation and objectives of the particular system.

Figure 8:
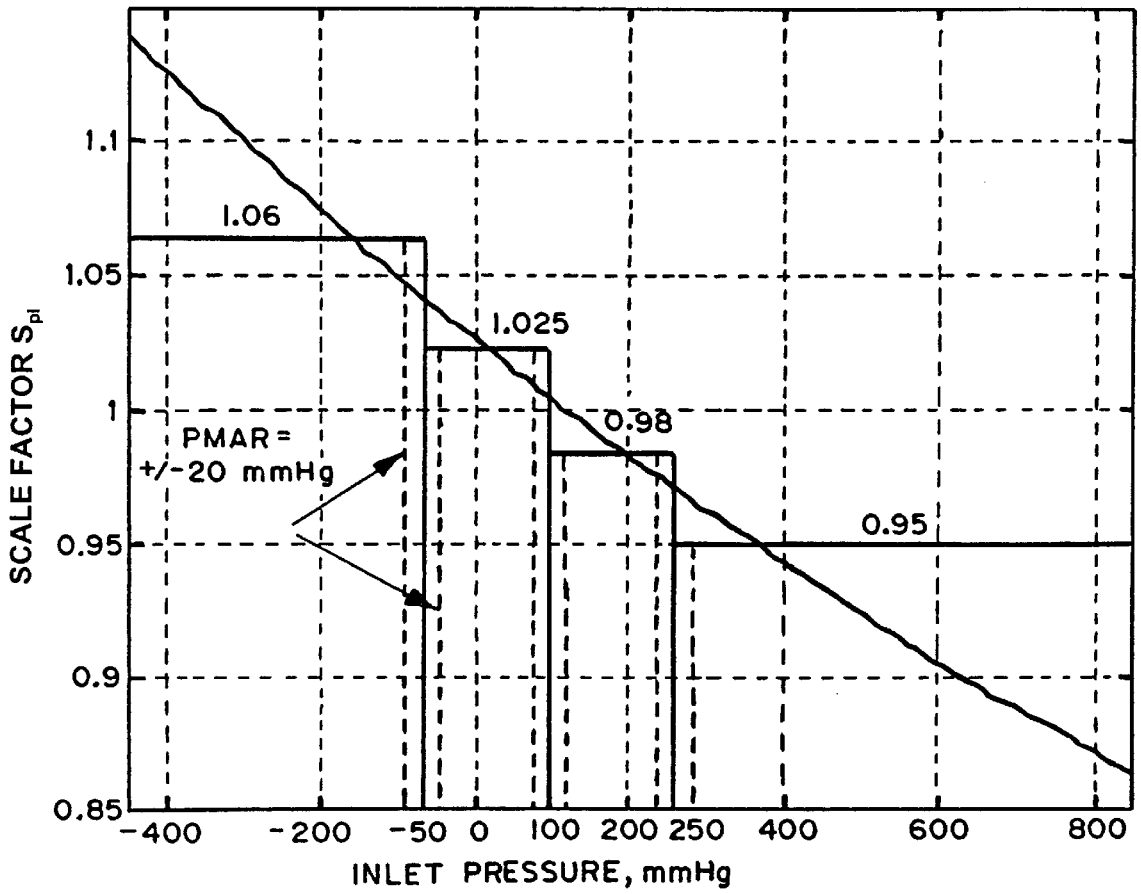
FIG. 8 is an overlay of the four nominal inlet pressure zones, defined based upon expected operational conditions, upon the scale factor curve shown in FIG. 7, through which a discrete scale factor value is selected for each nominal inlet pressure zone.

The defined nominal ranges are overlaid upon the scale factor curve derived for the type of pump used. FIG. 8 shows the overlay of the four nominal zones defined in the preceding paragraph on the scale factor curve shown in FIG. 7.

Given the overlay (of which FIG. 8 is a representative example), a discrete scale factor value is selected for each nominal zone. In FIG. 8, a discrete value of $S_{pi(i)}$=1.06 is selected for zone (i), which covers a low vacuum (negative pressure) condition. A discrete value of $S_{pi(ii)}$=1.025 is selected for zone (ii), which covers a transitional ambient negative to positive pressure condition. A discrete value of $S_{pi(iii)}$=0.98 is selected for zone (iii), which represents a low range of positive pressure conditions. A discrete value of $S_{pi(iv)}$=0.95 is selected for zone (iv), which covers a high range of positive pressure conditions.

The rationale for selecting a discrete value in each nominal zone can vary. For example, in zones (ii) and (iii), which encompass the normal expected operational conditions, the selected discrete values correspond generally with in the mid-values of the continuous scale factor in the respective zones. For zones (i) and (iv), which encompass less normal operational conditions, the selected discrete values generally correspond to the values of the continuous scale factor laying in the first 20% to 30% of the zone, where operational conditions experienced are most likely to occur.

In FIG. 8, PMAR equal to 20 mmHg is selected, to prevent frequent shifting between the selected discrete values when sensed inlet pressure is close to two nominal zones. Of course, other values for PMAR can be selected based upon criteria that the operator believes are most relevant to the operation and objectives of the particular system.

Based upon the foregoing methodology, a look up table of different, non variable discrete scale factor values $S_{pi}$ for the nominal zones (i) to (iv) selected for the system can be created, as follows:

TABLE 2

Look Up Table for $S_{Pi}$

| Sensed Pressure $P_i$ | Scale Factor ($S_{pi}$ |
|---|---|
| $P_i \leqq -50$ mmHg | 1.06 |
| $-50$ mmHg $< P_i \leqq +100$ mmHg | 1.025 |
| $+100$ mmHg $< P_i \leqq 230$ mmHg | 0.98 |
| $P_i > +230$ mmHg | 0.95 |

Following the initial selection of $S_{pi}$ according to Look Up Table 2, an algorithm 40 (see FIG. 9) evaluates a subsequently sensed value of $P_i$ to determine its proximity to the upper and lower pressure thresholds for the current $S_{pi}$. If the current $P_i$ is more than 20 mmHg above the upper pressure threshold of the current zone, then a new $S_{pi}$ is selected from Look Up Table 2, otherwise $S_{pi}$ remains unchanged until $P_i$ is sensed again. Likewise, if the current $P_i$ is more than 20 mmHg below the lower threshold of the current zone, then a new $S_{pi}$ is selected from Look Up Table 2, otherwise $S_{pi}$ remains unchanged until $P_i$ is sensed again.

Figure 9:
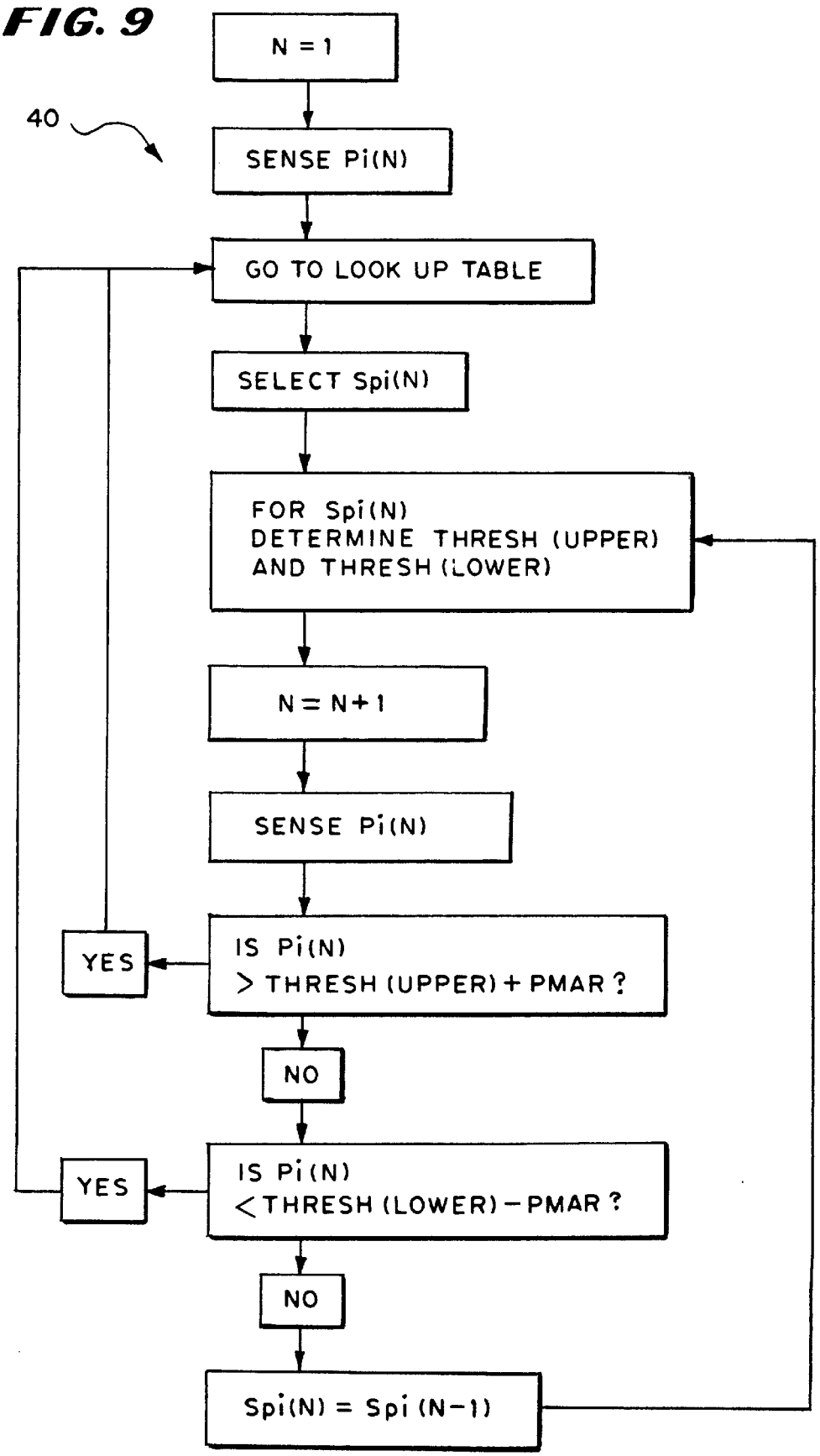
FIG. 9 is a flow chart showing an algorithm for implementing a pressure margin that mediates against frequent changes in the scale factor value if sensed inlet pressure is close to the threshold between two defined nominal pressure zones.
Figure 10:
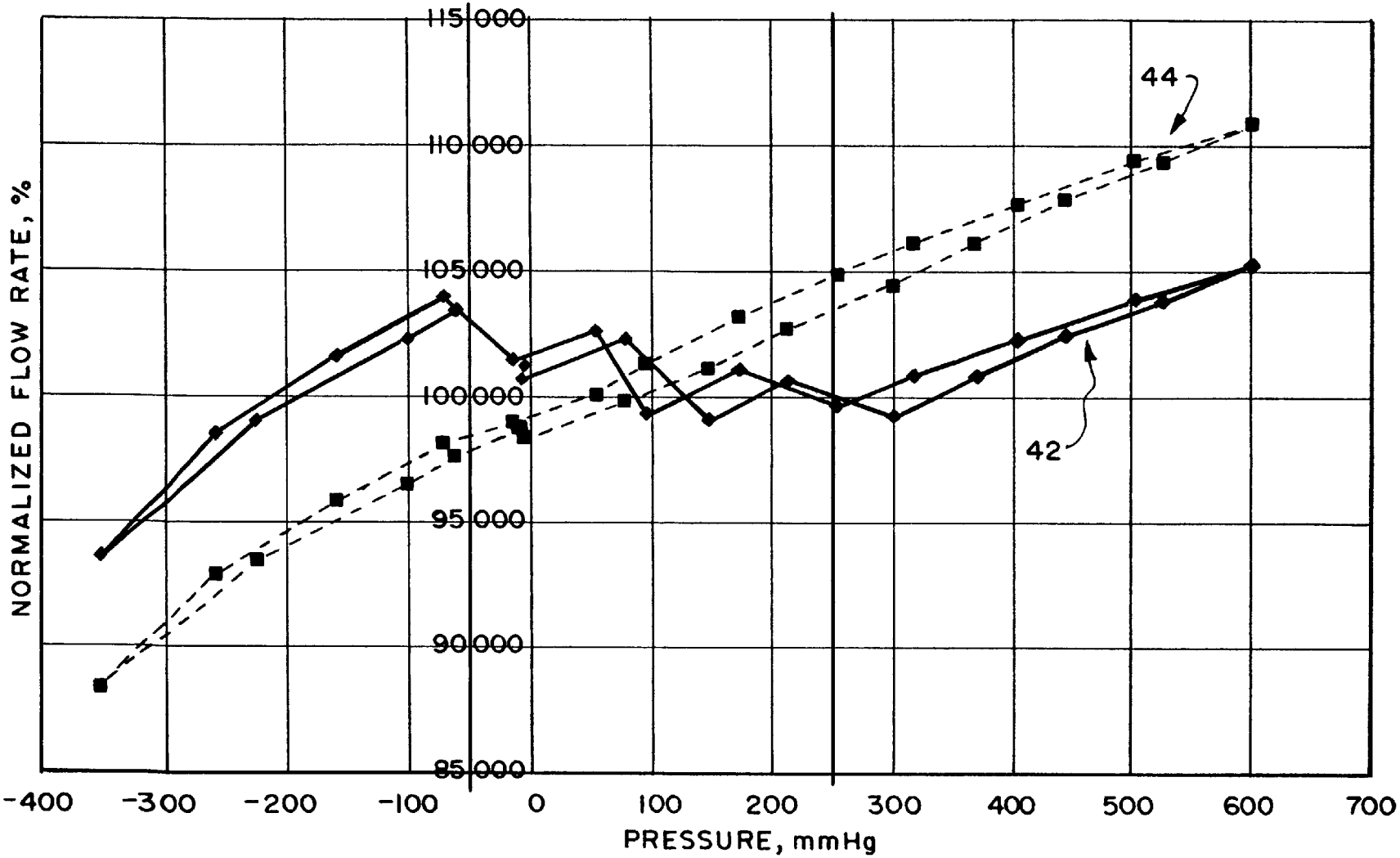
FIG. 10 is a plot of normalized commanded flow rate for a pump at a pump speed of 100 RPM (expressed on the Y-axis as a percent of flow rate over 100 RPM) versus actual flow rate for the pump at inlet pressures between −50 mmHg and 250 mmHg (X-axis), when the pump commands were adjusted using scale factor values which vary as a step function on inlet pressure, showing actual flow rate remaining essentially at the normalized commanded flow rate.

FIG. 10 shows a plot 42 of normalized commanded flow rate for a pump of the type evaluated at a pump speed of 100 RPM (expressed on the Y-axis as a percent of flow rate over 100 RPM) versus actual flow rate for the pump at inlet pressures between −50 mmHg and 250 mmHg (X-axis), when the pump commands were adjusted by $S_{pi}$ based upon Look Up Table 2, PMAR=20 mmHg, and the algorithm 40 in FIG. 9. FIG. 10 demonstrates that the actual flow rate remains essentially at the normalized commanded flow rate (100%) in this inlet pressure region, which reflects typical expected operational conditions for blood processing.

FIG. 10 also shows a plot 44 of the estimated flow rate, when not adjusted by $S_{pi}$, against the normalized commanded flow rate. FIG. 10 demonstrates that improved, accurate results are achieved by the use of discrete scale factors $S_{pi}$, which vary as step function over discrete pump inlet pressure ranges.

Provisions can be made in pump control algorithms designed to implement the use of discrete, step function scale factors $S_{pi}$, to accommodate real time adjustment of one or more of the individual scale factors $S_{pi}$, or redefinition or adjustment of the discrete pressure zones, or adjustment of PMAR, alone or in combination. Allowing the operator to adjust one or more of these factors aids the operator in optimizing performance accuracy in the field.

Various features of the invention are set forth in the following claims.

I claim:

1. A controller for peristaltic pump suited for processing blood and biological cellular suspensions and including a rotor assembly and a pump tube arranged to be engaged by the rotor assembly and having an inlet, the controller comprising a sensing element for sensing pressure at the inlet and providing a sensed output $P_i$, and a command module having an input coupled to the sensor to receive $P_i$, the command module including a processing element that derives a scale factor $S_{Pi}$ that varies according to a step function of $P_i$ and equals a first nonvariable value when $P_i$ lays in a first defined zone of inlet pressures, and equals a second nonvariable value, different than the first nonvariable value, when $P_i$ lays in a second defined zone of inlet pressures different than the first defined zone of inlet pressures, the command module also including an output that generates a pump speed command S based, at least in part, upon $S_{pi}$.

2. A controller according to claim 1 wherein the pump speed command S is derived, where $$S=Q\times C_T\times C_R\times S_{Pi}$$

and where:

Q is the desired flow rate, $C_T$ is a factor relating to the pump tube, and $C_R$ is a factor relating to the rotor assembly.

3. A controller for peristaltic pump suited for processing blood and biological cellular suspensions and including a rotor assembly and a pump tube arranged to be engaged by the rotor assembly and having an inlet, the controller comprising a sensing element for sensing pressure at the inlet and providing a sensed output $P_i$, and a command module having an input coupled to the sensor to receive $P_i$, the command module including a processing element that derives a pump calibration coefficient k, where:

$$k=f(C_T, C_R, S_{Pi})$$

and where:

f is a mathematical function, $C_T$ is a factor relating to the pump tube, $C_R$ is a factor relating to the rotor assembly, and $S_{Pi}$ is a scale factor that varies as a step function of $P_i$, the command module also including an output that generates a pump speed command S, where $$S=Q\times C_T\times C_R\times S_{Pi}$$

and where:

Q is the desired flow rate.

4. A controller according to claim 3 wherein, according to the step function $S_{pi}$ equals a first nonvariable value when $P_i$ lays in a first defined zone of inlet pressures, and equals a second nonvariable value, different than the first nonvariable value, when $P_i$ lays in a second defined zone of inlet pressures different than the first defined zone of inlet pressures.

* * * * *